US009787043B2

(12) United States Patent
Jossifidis

(10) Patent No.: US 9,787,043 B2
(45) Date of Patent: Oct. 10, 2017

(54) HAND CRIMP TOOL

(71) Applicant: DELPHI INTERNATIONAL OPERATIONS LUXEMBOURG S.A.R.L., Bascharage (LU)

(72) Inventor: Ilias Jossifidis, Nuremberg (DE)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 269 days.

(21) Appl. No.: 14/414,505

(22) PCT Filed: Jun. 27, 2013

(86) PCT No.: PCT/EP2013/063561
§ 371 (c)(1),
(2) Date: Jan. 13, 2015

(87) PCT Pub. No.: WO2014/016075
PCT Pub. Date: Jan. 30, 2014

(65) Prior Publication Data

US 2015/0171584 A1 Jun. 18, 2015

(30) Foreign Application Priority Data

Jul. 23, 2012 (WO) ..... PCT/IB2012/001664

(51) Int. Cl.
*H01R 43/042* (2006.01)

(52) U.S. Cl.
CPC ..... *H01R 43/042* (2013.01); *Y10T 29/53226* (2015.01)

(58) Field of Classification Search
CPC ..... H01R 43/042; Y10T 29/53226
See application file for complete search history.

(56) References Cited

U.S. PATENT DOCUMENTS 3,492,854 A * 2/1970 Eppler ..... H01R 43/042 140/113
3,710,610 A * 1/1973 McCaughey ..... H01R 43/045 29/751

(Continued)

FOREIGN PATENT DOCUMENTS

DE 4023337 C1 10/1991
DE 102008002512 A1 12/2009

(Continued)

OTHER PUBLICATIONS

International Search Report PCT/EP2013/063561, published Jul. 22, 2013.

*Primary Examiner* — Carl Arbes
(74) *Attorney, Agent, or Firm* — Robert J. Myers

(57) ABSTRACT

The invention relates to an hand crimp tool for crimping electrical contact terminals onto electrical cables. This hand crimp tool comprises a crimping frame with two substantially parallel guide rails, and the lever handles configured to be manually operated. The hand crimp tool further comprises a first crimping die and a corresponding second crimping die, at least one of which being mounted to a die carrier. The guide rails are substantially bar-shaped and oriented in a common longitudinal direction. The die carrier is configured to slide in a linear direction parallel to the longitudinal direction of the guide rails, along inner opposite faces of the guide rails, thereby being guided from a cable receiving position to a crimping position.

27 Claims, 5 Drawing Sheets

(56) References Cited

U.S. PATENT DOCUMENTS

| | | | | | |
|---|---|---|---|---|---|
| 4,982,630 | A * | 1/1991 | Schmode | B26B 17/02 | 81/346 |
| 5,042,286 | A * | 8/1991 | Wiebe | B25B 7/12 | 29/751 |
| 5,153,984 | A | 10/1992 | Beetz | | |
| 5,307,553 | A * | 5/1994 | Frohlich | H01R 43/045 | 29/566.2 |
| 5,647,119 | A * | 7/1997 | Bourbeau | H01R 43/042 | 29/751 |
| 5,870,925 | A * | 2/1999 | Morris | B25B 27/146 | 29/751 |
| 8,234,904 | B2 * | 8/2012 | Kerner | B25B 27/146 | 206/313 |
| 2005/0050940 | A1 | 3/2005 | Ishizuka et al. | | |
| 2011/0197647 | A1 | 8/2011 | Springston, II | | |
| 2011/0197648 | A1 | 8/2011 | Houser et al. | | |
| 2011/0235312 | A1 | 9/2011 | Houser et al. | | |

FOREIGN PATENT DOCUMENTS

| | | | |
|---|---|---|---|
| EP | 1503454 | A1 | 2/2005 |
| EP | 2362501 | A1 | 8/2011 |
| WO | 9856081 | A1 | 12/1998 |

* cited by examiner

HAND CRIMP TOOL

CROSS-REFERENCE TO RELATED APPLICATION

This application is a national stage application under 35 U.S.C. §371 of PCT Application Number PCT/EP2013/063561 having an international filing date of Jun. 27, 2013, which designated the United States, said PCT application claiming the benefit of PCT Application Number PCT/IB2012/001664, having an international filing date of Jul. 23, 2013, which also designated the United States, the entire disclosure of each of which are hereby incorporated herein by reference.

TECHNICAL FIELD OF THE INVENTION

The present invention relates to a hand crimp tool with removable crimping dies to be used for manually crimping electrical contact terminals onto electrical cables.

BACKGROUND OF THE INVENTION

Electrical contact terminals are used for the connection of electrical cables, which typically consist of an insulation sheath surrounding a single conductor or a plurality of wires, to electrical components. In particular in the automotive industry, usually contact terminals are connected to electrical cables via crimping.

To this end, the contact terminals comprise, on one end, opposite crimping wings which, upon crimping, are bent around a corresponding portion of an electrical cable which, for this purpose, is inserted between those crimping wings.

To perform the crimping action, the corresponding crimping tools are provided with respective crimping dies, which usually consist of a crimping punch and a crimping anvil. Upon crimping, typically the contact terminal with the cable inserted in a corresponding crimping portion is placed between respective crimping dies, particularly between the crimping anvil and the crimping punch. These crimping dies are provided with surfaces which are shaped such that upon moving the crimping dies together, the crimping wings are bent into the desired shape around the inserted cable.

Usually, separate pairs of crimping wings are provided, particularly for a contact crimping portion to be crimped around a stripped off end portion of the cable, and for an insulation crimping portion to be crimped around the adjacent cable insulation. In particular, in mass production facilities, crimping processes are performed by corresponding automated crimping tools while, if only fewer crimping operations are needed, as for example upon domestic use or also e.g. in smaller car repair shops, typically crimping actions are performed using hand crimp tools which are to be manually operated.

A typical crimping process for connecting a contact terminal to a corresponding electrical cable is disclosed in EP 1 503 454 A1. The contact terminals are provided with a contact crimping portion and an insulation crimping portion to be crimped respectively to a stripped off end section of a cable and an insulation section of the cable. The crimping wings for the contact crimping portion and the insulation crimping portion are provided with different suitable lengths in correspondence to the different cross-sections of the contact crimping portion and the insulation crimping portion.

An example of a crimping apparatus, as it is used in mass production facilities, is described in US 2005/0050940 A1.

The apparatus described therein can adapt the distance between the corresponding crimping dies in accordance with crimping portions of different thicknesses by means of a pre-adjustment of the distance between the corresponding crimping dies. To this end, the apparatus is provided with a mechanism which is based on the rotation of a member with a polygonal cross-section and which can be rotated into different positions corresponding to the number of sides of the polygon. This member is arranged such that when it is rotated into a certain position, one of the crimping dies is moved with respect to the other by a certain amount depending on the position. Thus, this mechanism allows pre-adjusting the distance between the crimping dies by certain predefined amounts. However, by this mechanism, it is not possible to continuously fine tune this distance.

A further crimping tool is described in DE 10 2008 002 512 A1. Therein, a hand crimp tool is described which can be manually operated by a person. This tool comprises two handles, wherein one of the handles is stiffly connected to a frame, while the other handle is operatively connected to a die carrier which removably supports a first crimping die. A further crimping die can be removably arranged within the frame, and the distance between those dies can be pre-adjusted based on a mechanism similar to the one described above. Upon crimping, an operator presses handles together, whereby the die carrier is moved together with the first crimping die towards the other crimping die essentially by means of a lever action. Even though the construction is designed to reduce rotational movements of the crimping dies, due to the lever-pivot mechanism, at least small rotational movements cannot be fully avoided. Therefore, this construction requires the crimping dies to be precisely mounted without any angular deviations. In order to maintain this precise mounting, a continuous maintenance of this hand crimp tool is mandatory.

Accordingly, it is an object of the present invention to improve the state of the art by providing a hand crimp tool which requires less maintenance. It is a further object of the present invention to provide a hand crimp tool with a mechanism which allows an easy fine tuning of the distance between the crimping dies.

These and other objects, which become apparent upon reading the following description, are solved by a hand crimp tool according to the present invention.

BRIEF SUMMARY OF THE INVENTION

According to the present invention, a hand crimp tool for crimping electrical contact terminals to electrical cables is provided, wherein the hand crimp tool comprises a crimping frame with two substantially parallel guide rails, a first lever handle and a second lever handle, which are configured to be manually operated by an operator, thereby being brought from an open configuration to a closed configuration. The lever handles may be in the open configuration when the hand crimp tool is not used. When an operator uses the hand crimp tool, the lever handles are manually operated, i.e. for example pressed to be moved towards each other, until the crimping is completed.

According to the present invention, the lever handles are arranged such that, after being operated, the handles can only return into the open configuration after a full crimping action is completed. In other words, if the lever handles are operated only partially, i.e. for example pressed only partially, they cannot be returned into the open configuration.

However, for example, security mechanisms are not excluded which, if necessary, allow returning the lever handles into the open configuration, even though the crimping action is not fully completed. This may for example be necessary when elements of the hand crimp tool are unwittingly tilted or misaligned such that a further operation of the lever handles towards the closed configuration is no longer possible.

According to the invention, the hand crimp tool further comprises a first crimping die, a corresponding second crimping die and a die carrier which is configured to support the first crimping die. Hereby, the first and second crimping dies can be crimping anvils and crimping punches.

The crimping dies may correspond to crimping dies as they are used in crimping machines for mass production facilities. In other words the dimensions of the crimping dies correspond to the dimensions of those typically used in mass production crimping machines. This offers the possibility to test crimping dies designed for mass production machines by using the hand crimp tool, thereby avoiding the necessity to mount the crimping dies into the mass production crimping machines which might require stopping a whole assembly line.

The carrier is operatively connected to at least one of the lever handles. For example, the carrier can be connected to one or both handles by means of hinge mechanisms. According to the invention, the guide rails are substantially bar-shaped and oriented in a common longitudinal direction. Thereby, small deviations from the common longitudinal direction are possible, as long as the carrier is configured to slide in a linear direction parallel to the longitudinal direction of the guide rails. Thereby, the carrier slides along inner opposing faces of the guide rails, being guided from a cable-receiving position to a crimping position.

The cable-receiving position corresponds to the open configuration of the lever handles. In other words, when the carrier is in the cable-receiving position, a cable and a corresponding contact terminal can be placed between the crimping dies. Upon operation of the hand crimp tool, the carrier moves from this position linearly towards the crimping position and upon reaching the crimping position, the action of crimping the contact terminal to the cable is completed.

The movement of the carrier essentially does not comprise a component which is to be rotated. Thereby, upon mounting the crimping dies to the hand crimp tool, due to the crimping frame, the crimping dies are held in a correct orientation which, due to the guiding of the crimping frame, is maintained throughout the movement of the first crimping die upon crimping.

Thus, due to the crimping frame, the hand crimp tool requires less maintenance as compared to lever-pivot based crimping tools while, at the same time, it is of a stable and compact construction.

Thus, it is a feature of the present invention that the hand crimp tool is provided with a crimping frame with two guide rails which serve for guiding the carrier within the frame in a linear fashion, wherein, the movement of the carrier is guided and secured by the inner faces of the guide rails.

Thereby, due to the guidance of the carrier within the frame, the orientation of the frame and the direction of movement is secured even throughout many crimping cycles. In other words, due to the inventive crimping frame, the inventive hand crimp tool is less susceptible to misalignment, and the need for maintenance is reduced.

The hand crimp tool is configured to be provided with crimping dies as used in mass production facilities. Thereby, at least one of the crimping dies has a length between 40 millimeters (mm) and 100 mm, possibly between 40 mm and 90 mm or between 50 mm and 85 mm. Further, upon crimping, the hand crimp tool is configured to apply a maximum crimp force between 100 Newton (N) and 10000 N, possibly between 500 N and 9500 N, 750 N and 9000 N, or 1200 N and 8000 N.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
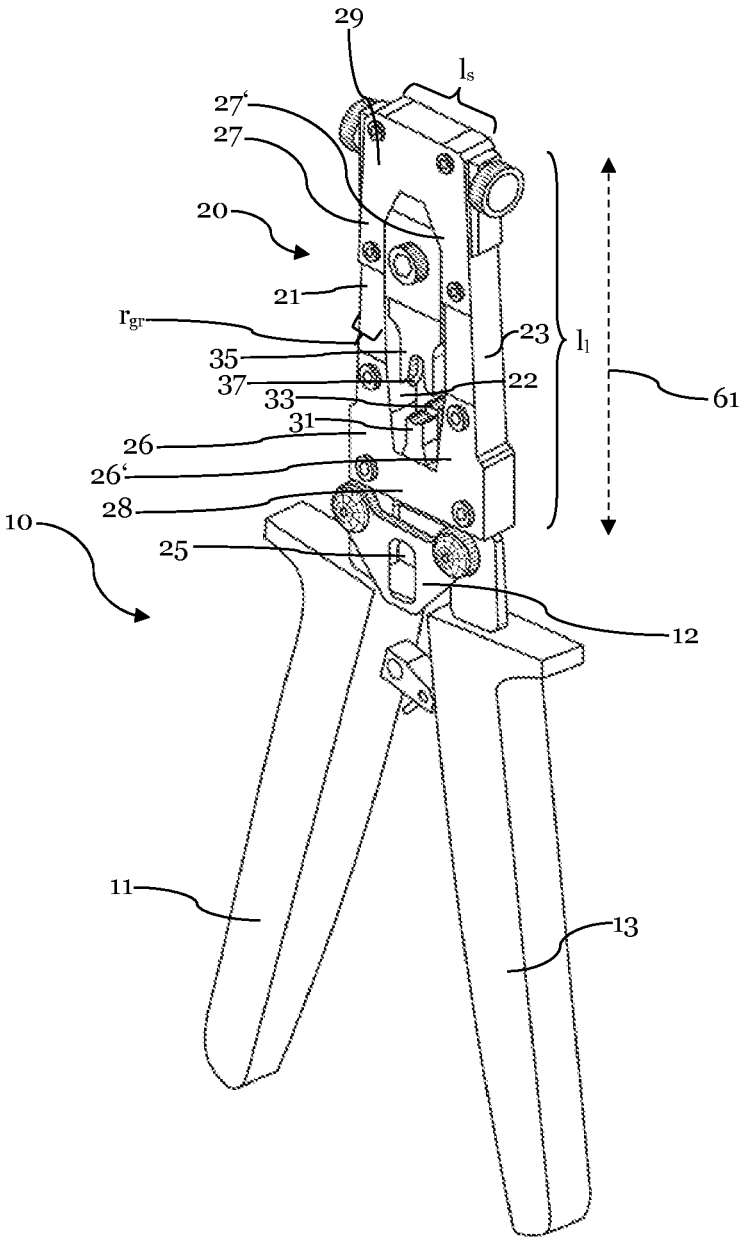
FIG. 1 shows a schematic three-dimensional view of the hand crimp tool.

FIG. 1 shows a hand crimp tool 10 which can be used for crimping contact terminals to electrical cables, wires or similar electrical conductors. As shown, the hand crimp tool 10 comprises first and second lever handles 11, 13 which can be manually operated by a person, for instance pressed together in the shown example, for performing a crimping action.

In the FIG. 1, the first and second lever handles 11, 13 are shown in an open configuration and upon operation the handles 11, 13 can be brought from the open configuration to a closed configuration.

As depicted, the hand crimp tool 10 is further provided with a crimping frame 20, which, forms substantially a closed rectangle. Thereby, the closed shape of the crimping frame 20 as it is shown provides for optimal stability of the hand crimp tool 10 and allows a compact construction. Necessary openings, such as an opening for crimping die, can be advantageously incorporated into the compact frame construction.

As further depicted in FIG. 1, the hand crimp tool 10 comprises a first crimping die 31, 33 and a corresponding second crimping die 35, 37. The first crimping dies 31, 33 and the second crimping die 35, 37 are arranged substantially within the crimping frame 20 between two guide rails 21, 23 of the crimping frame 20.

The first crimping die 31, 33 is supported by a die carrier 25, which is operatively connected to at least one of the first and second lever handles 11, 13 and slidably arranged between the guide rails 21, 23. The first and second lever handles 11, 13 are mutually connected by a joint element 12. At least one of the first and second lever handles 11, 13 is connected to the die carrier 25 by means of a suitable hinge mechanism.

Advantageously, the guide rails 21, 23 are substantially bar-shaped and are oriented in a common longitudinal direction 61. In other words, the guide rails 21, 23 are elongated members, which, in different embodiments, can be provided with different cross-sections such as round or irregular cross-sections. These elongated members are substantially mutually parallel to be optimally suited for guiding the die carrier 25.

In the shown embodiment, at least the length of one side of the shown cross-section of the guide rails $r_{gr}$, a rectangular cross-section of the guide rails $r_{gr}$, may be on the order of a few millimeters, 2 mm to 10 mm.

The crimping frame 20 has a long side of length $l_l$, which is within the range of about 90 mm to 150 mm.

The ratio $l_l/r_{gr}$ may be from 5 to 20, 6 to 18, or 7 to 16. Alternatively, the ratio $l_l/r_{gr}$ may be from 5 to 20, 5 to 14, or 11 to 13. For example, if the long side of length $l_l$ of the crimping frame 20 is 100 mm and the length of one side of the cross-section $r_{gr}$ is 10 mm, the ratio $l_l/r_{gr}$ is 10.

As shown in FIG. 1, the guide rails 21, 23 are mounted with respective proximal rail ends 26, 26' to a frame base 28. The frame base 28, is advantageously arranged substantially perpendicular to the longitudinal direction 61 of the guide rails 21, 23. Moreover, the frame base 28 surrounds at least partially the first crimping die 31, 33 when the die carrier 25 is in a cable receiving position as shown in FIG. 1. As particularly shown in FIG. 1, the frame base 28 is formed by a plate which is screwed to both guide rails 21, 23, thereby firmly connecting the guide rails 21, 23.

On the opposite side, not visible in FIG. 1 due to the perspective view, a similar plate is provided such that the frame base 28 surrounds corresponding portions of the die carrier 25 and the first crimping die 31, 33.

Further, the guide rails 21, 23 are mutually connected at respective distal rail ends 27, 27', via an substantially U-shaped support arch 29, which is configured to support the second crimping die 35, 37.

By the provision of frame base 28 to support the guide rails 21, 23, a compact and stable construction is provided which is further improved by the provision of the support arch 29.

According to the invention, upon operation of the first and second lever handles 11, 13, the die carrier 25 slides in a linear direction, parallel to the longitudinal direction 61 of the guide rails 21, 23, along inner opposite faces 22, only one of which is visible due to the perspective view of the FIG. 1, of the guide rails 21, 23. Thereby the die carrier 25 is guided from the cable receiving position to a crimping position.

When the die carrier 25 is placed in the cable receiving position, an operator can place a contact terminal with an inserted cable between the first crimping dies 31, 33 and the second crimping dies 35, 37. Upon moving the die carrier 25 from the cable receiving position towards the crimping position, i.e. in a upward direction in the FIG. 1, corresponding crimping wings of the contact terminal are bent and the contact terminal is crimped to the cable.

The crimping frame 20 is constructed such that upon movement of the die carrier 25, the die carrier 25 is supported and surrounded by the crimping frame 20 such that its movement is guided and determined by the crimping frame 20.

Thereby, the movement of the die carrier 25 from the cable receiving position to the crimping position does substantially not involve a rotational component.

As compared to lever-pivot based constructions as known from the prior art, with the crimping frame 20, the present construction provides the advantage that, for example, an unwanted tilting of the die carrier 25 and/or the first crimping die 31, 33 is prevented. Thus, due to the crimping frame 20, a higher crimping precision can be achieved and the construction is less susceptible to misalignment. As a result, the hand crimp tool 10 requires less maintenance.

As shown in FIG. 1, the crimping frame 20 essentially consists of the frame base 28, the guide rails 21, 23 and the support arch 29. In this form, with only the minimum of necessary elements, the frame base 28 provides for a high stability of the hand crimp tool 10 and allows for a stable guidance of the die carrier 25 within the crimping frame 20.

The crimping frame 20 has a short side of length $l_s$, as shown in FIG. 1, and a corresponding ratio of the long side length $l_l$ to the length of a short side $l_s$, i.e., the ratio $l_l/l_s$ may be from 1 to 5, 2 to 4, 2.5 to 3.5, or 2.8 to 3.2. For example, if the length of the long side $l_l$ is 100 mm and the length of the short side is 40 mm, the resulting ratio $l_l/l_s$ is 2.5.

The second crimping die 35, 37 is removably mounted to the support arch 29. The die carrier 25 is configured to support two first crimping dies 31, 33. Moreover, the two first crimping dies 31, 33 may be crimping anvils as depicted in FIG. 1. Similarly, two second crimping dies 35, 37 are provided which may be crimping punches.

As shown, in assembled condition, the second crimping dies 35, 37 are mounted between the guide rails 21, 23, to the substantially U-shaped support arch 29.

The first crimping dies 31, 33 and the second crimping dies 35, 37 correspond to crimping dies as they are used in automated crimping machines in mass production.

The first crimping die 31, 33, is removably mounted to the die carrier 25. The second crimping die 35, 37 is removably mounted to the support arch 29.

Thus, the hand crimp tool 10 can advantageously be used to test crimping dies which, for example, are newly designed for an automated crimping machine such that, for this test, the crimping dies do not need to be mounted to an automated crimping tool used in a production line.

In this document "crimping die removably mounted" means that the crimping die is quite easily took down and disassembled so as to replace it in the crimping frame 20. Indeed, it is a particular advantage of the present invention to use standard crimping dies used in mass production and to select their length, shape, gap in between, in particular with spacers having various thicknesses, etc., according to the wire diameter, to the terminal type, etc. For example, the time for changing the crimping dies should be only few minutes, e.g. less than 10 minutes, and may be less than 5 minutes.

Figure 2:
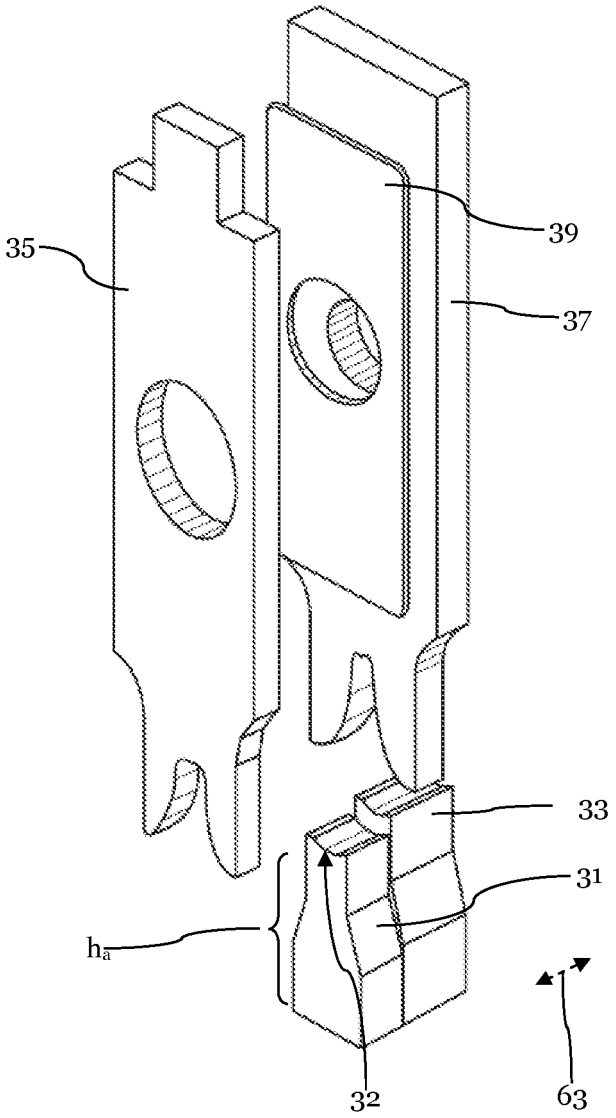
FIG. 2 shows a schematic exploded view of the crimping dies.

FIG. 2 shows first crimping dies 31, 33 and second crimping dies 35, 37 in a schematic three-dimensional view. The first crimping dies 31, 33 are provided with different anvil heights $h_a$ and/or surfaces 32 of the first crimping dies 31, 33 are provided with different forms and/or radii of curvature. Thereby, the first crimping die's height $h_a$ is used herein to illustrate that the respective first crimping dies 31, 33 operate at different heights and can be selected in correspondence with a desired crimping cross-section. For example, a first crimping die 31 can be used for crimping a corresponding insulation crimping portion of a contact terminal around a non-stripped portion of an electrical cable, while a second first crimping die 33 may be used to crimp the contact crimping portion of a contact terminal around a stripped portion of the inserted cable. The different first crimping die's heights $h_a$ in combination with correspondingly differently shaped second crimping dies 35, 37 allow achieving different crimping cross-sections of the contact crimping portion and the insulation crimping portion.

Similarly, the first crimping dies 31, 33 may be provided with different radii of curvature of the upper crimping surfaces, which may be used similarly to achieve different cross sections of the resulting crimped sections.

The first crimping dies 31, 33 are arranged on the die carrier 25 such that the first crimping dies 31, 33 can be moved with respect to each other in a second direction 63. The second direction 63, as it is shown in FIG. 2, is substantially perpendicular to the longitudinal direction 61 of the guide rails 21, 23.

By providing the first crimping dies 31, 33 movable in this manner, the relative distance between the two first crimping dies 31, 33 can be adjusted as needed, for example, in accordance with the dimensions of an inserted contact terminal. Similarly, also the second crimping dies 35, 37 may be movable in a similar direction with respect to each other.

The hand crimp tool 10 may further comprise a spacer 39 which can be inserted between the two first crimping dies 31, 33 and/or the two second crimping dies 35, 37. As shown in FIG. 2, such a spacer 39 can be used to adjust the relative position of first crimping dies 31, 33 and/or of second crimping dies 35, 37 in the second direction 63.

The crimping frame 20 comprises adjusting means 50 for continuously moving the second crimping die 35, 37 substantially parallel to the longitudinal direction 61 of the guide rails 21, 23 to allow a pre-adjusting of the distance between the corresponding crimping dies. Such adjusting means 50 are exemplarily depicted in FIG. 3. As one can derive from this figure, these means comprise two corresponding adjustment members 51, 53, e.g. corresponding wedges, which are arranged movable in a third direction 65, which may be substantially perpendicular to the longitudinal direction 61 of guide rails 21, 23.

To this end, the first adjustment member 51 is provided with a bore with inner screw threads and the crimping frame 20 is provided with a corresponding screw 55. Upon movement, e.g. due to turning the screw 55, inclined abutment surfaces 52, 54 of adjustment members 51, 53 mutually abut each other, such that the adjustment member 53 is pressed in a fourth direction substantially parallel to the longitudinal direction 61 of the guide rails 21, 23.

As shown, the second crimping die 35, 37 is directly mounted to adjustment member 53 such that upon movement of the adjustment member 53, the second crimping die 35, 37 is moved in a similar way. Thereby, it becomes possible to continuously adjust the position of the second crimping die 35, 37 with respect to the first crimping die 31, 33. In other words, it becomes possible to continuously adjust the minimum distance between the first crimping die 31, 33 and the second crimping die 35, 37 to a desired diameter of a resulting crimp, as illustrated in the lower part of FIG. 3.

Figure 3:
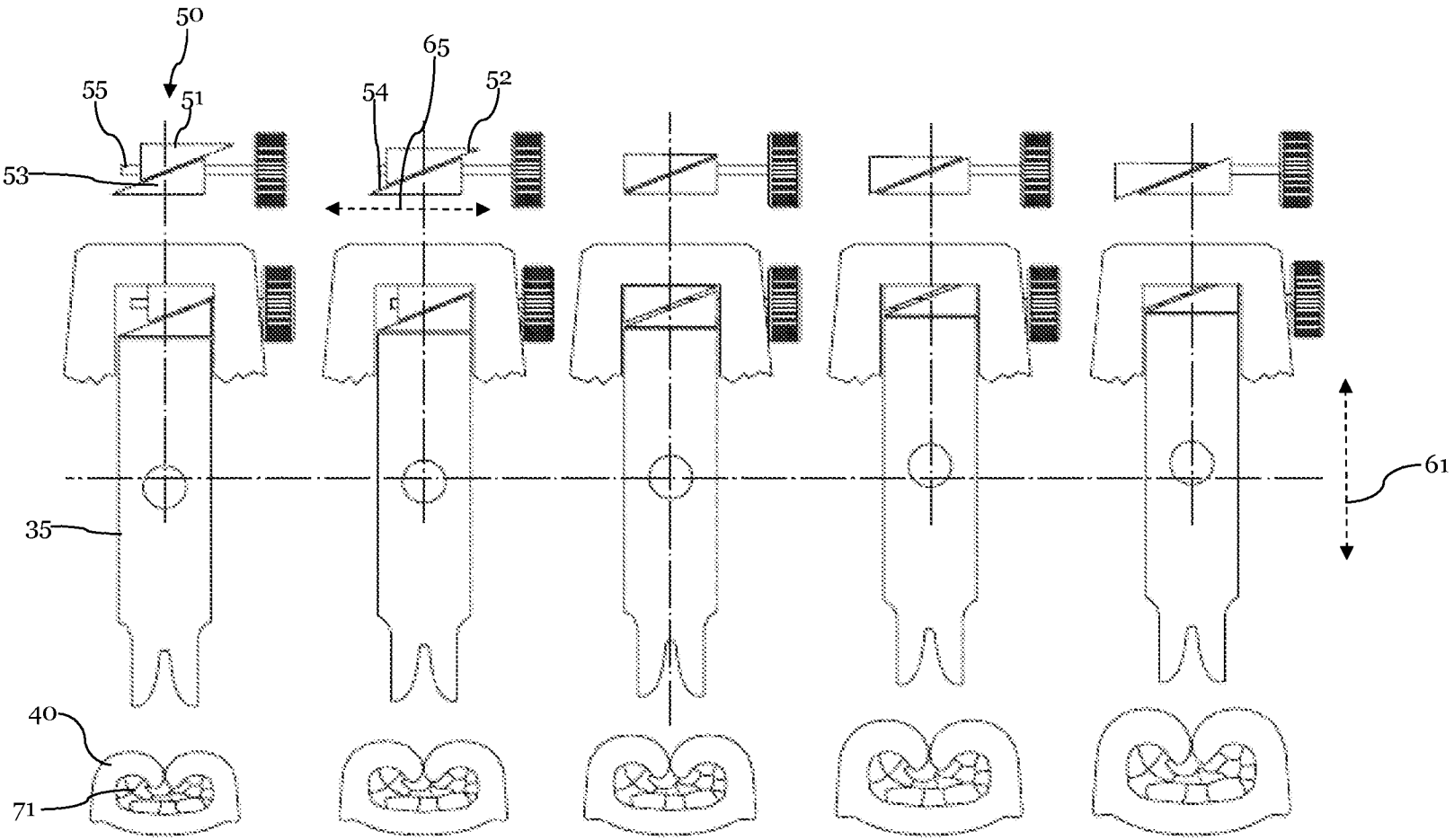
FIGS. 3 to 5 schematically illustrate means for moving crimping dies for the provision of a pre-adjustment.

In the lower part of FIG. 3, a cross section through a crimp connection of a contact crimping portion of a contact terminal 40 is depicted which is crimped around stripped cable strands 71 of an electrical cable.

As one may derive from the different cross sections depicted in this lower part, upon continuously adjusting the second crimping die 35, 37, the diameter of the resulting crimp connection can be adjusted. Thus, due to these means for continuously moving the second crimping die 35, 37, a continuous pre-adjustment of the distance between corresponding crimping dies, e.g. between crimping anvils and crimping punches, is possible.

Figure 4:
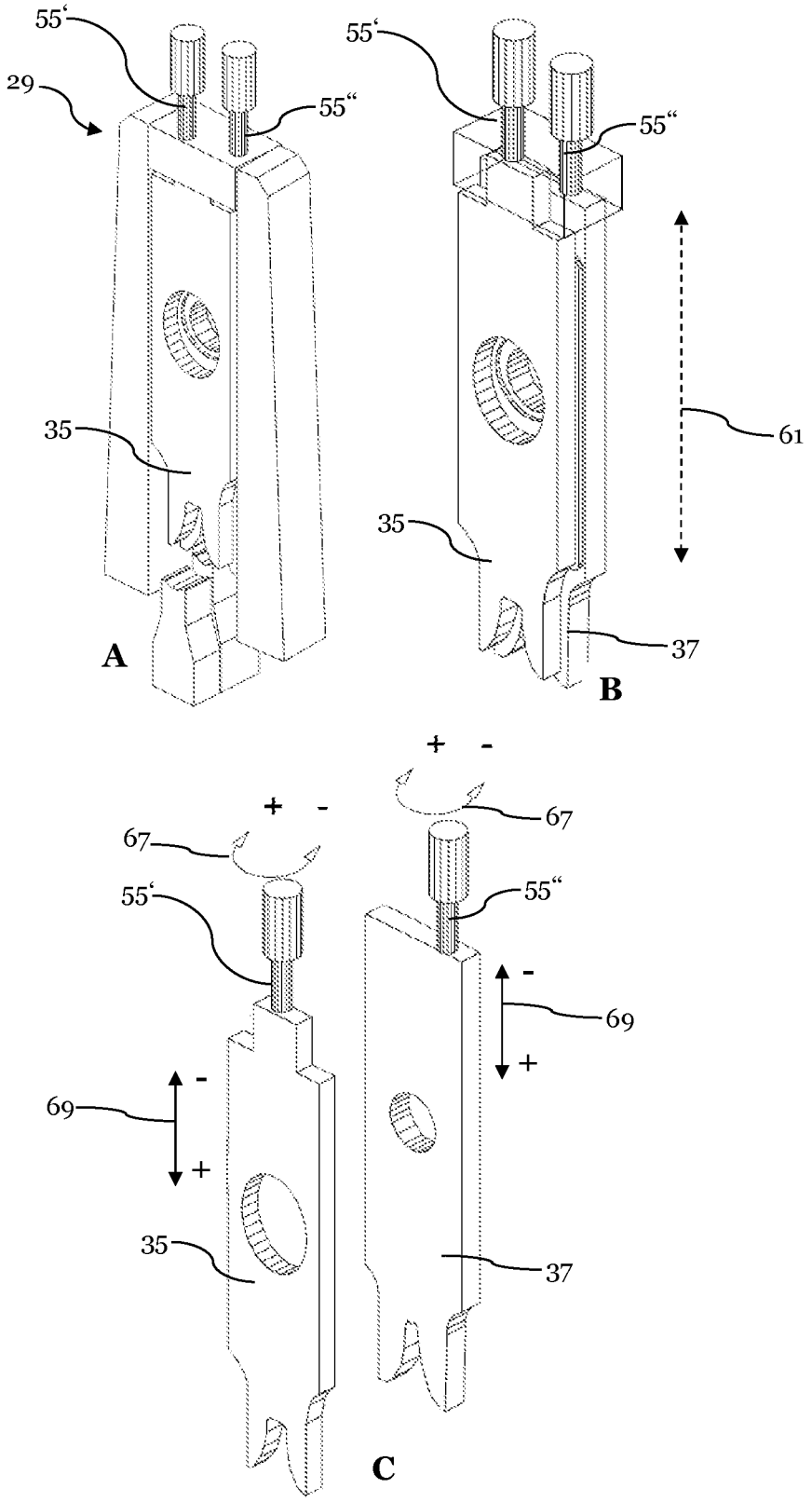

FIGS. 4A to 4C illustrate a non-limiting example, wherein the adjusting means for continuously moving the second crimping die 35, 37 comprises at least one screw 55', 55" which is configured to be screwed into a corresponding bore hole with inner threads which is provided in the U-shaped support arch 29. As shown in FIGS. 4A and B, to this end, bore holes are provided such that the screw 55', 55" can be inserted in a fifth direction substantially parallel to the longitudinal direction 61.

Upon clockwise rotation of the screw 55', 55", indicated by a plus sign and rotational arrows 67 in FIG. 4C, the second crimping dies 35, 37 are moved along the longitudinal direction 61 downwardly in the figures as indicated by a plus sign and arrow 69 in FIG. 4C. Similarly, when the screw 55', 55" is rotated in a counter clockwise direction as indicated by the minus sign and rotational arrow 67, the crimping dies 35, 37 move along the longitudinal direction 61 upwardly in the figure.

To this end, the crimping dies 35, 37 can, for example, be pressed in a direction downwardly in the figure by the screw 55', 55", when the screw 55', 55" is rotated in clockwise direction. Upon counter clockwise rotation of the screw 55', 55", an upward movement of the crimping dies 35, 37 can, for example, be enabled by a suitable spring mechanism which provides a force which acts on the second crimping dies 35, 37 thereby pressing the same upwardly in the figure.

Figure 5:
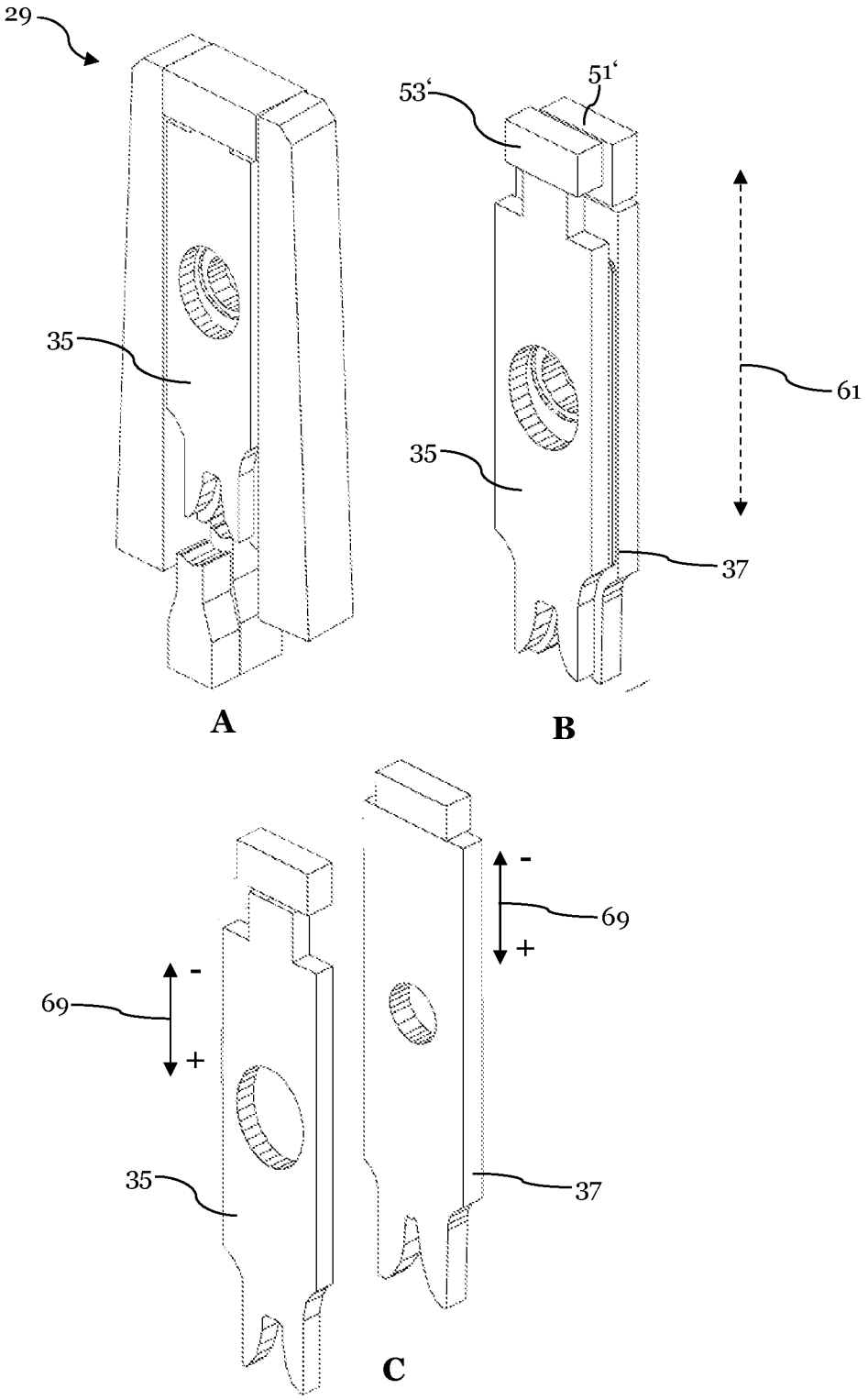

As illustrated in FIGS. 5A to 5C, at least one means for non-continuously moving, the second crimping die 35, 37 in a direction substantially parallel to the longitudinal direction 61 is provided which is used in combination with the above described means for continuously moving the second crimping die 35, 37.

As illustrated, the means for non-continuously moving the second crimping die 35, 37 can be provided in form of adjusting members 51', 53', for example box shaped metal or plastic parts or metal or plastic plates, of suitable size which can be removably provided within the U-shaped support arch 29 and which support the crimping dies 35, 37 as shown in FIG. 5A. These adjusting members 51', 53' can be selected based on their size to shift the second crimping dies 35, 37 in a direction downwardly in the figure as illustrated by the plus sign and arrow 69 in FIG. 5C to provide a rough adjustment of the distance between the first crimping dies 31, 33 and the second crimping dies 35, 37.

The invention claimed is:

1. A hand crimp tool for crimping electrical contact terminals onto electrical cables, comprising:

a crimping frame with two substantially parallel guide rails, a first lever handle, and a second lever handle, wherein the first and second lever handles are configured to be manually operated by an operator, thereby being brought from an open configuration to a closed configuration;

a first crimping die and a corresponding second crimping die; and a die carrier configured to support the first crimping die or the second crimping die, wherein the die carrier is operatively connected to the first lever handle or the second lever handle and is slideably arranged between the guide rails, wherein the guide rails are substantially bar-shaped and oriented in a common longitudinal direction, wherein the die carrier is configured to slide in a linear direction parallel to the a longitudinal direction of the guide rails along inner opposite faces of the guide rails, thereby being guided from a cable receiving position to a crimping position, wherein the die carrier is configured to support two first crimping dies, wherein the two first crimping dies are crimping anvils and are provided at different anvil heights or wherein surfaces of the two first crimping dies are provided with different radii of curvature, and wherein the two first crimping dies are arranged on the die carrier such that the two first crimping dies can be moved with respect to each other in a direction which corresponds to an orientation of a cable which is received by the hand crimp tool for crimping.

2. The hand crimp tool according to claim 1, wherein the crimping frame has a long side of length and a short side of length, and wherein a ratio of the long side of length to the short side of length is in a range of 1:1 to 5:1.

3. The hand crimp tool according to claim 1, wherein the crimping frame has a long side of length and the guide rails have a substantially rectangular cross-section, and wherein a ratio of the long side of length and a length of one side of the rectangular cross-section is in a range of 5:1 to 20:1.

4. The hand crimp tool according to claim 1, wherein the crimping frame further comprises means for continuously moving the second crimping die substantially parallel to the longitudinal direction of the guide rails.

5. The hand crimp tool according to claim 4, wherein the means for continuously moving the second crimping die comprise two corresponding adjustment members.

6. The hand crimp tool according to claim 1, wherein at least one means for non-continuously moving the second crimping die in a direction substantially parallel to the longitudinal direction is provided for providing a rough adjustment of a distance between the corresponding first and second crimping dies.

7. The hand crimp tool according to claim 1, wherein at least one of the first crimping die and second crimping die is removably mounted to the crimping frame.

8. A hand crimp tool for crimping electrical contact terminals onto electrical cables, comprising:

a crimping frame with two substantially parallel guide rails, a first lever handle, and a second lever handle, wherein the first and second lever handles are configured to be manually operated by an operator, thereby being brought from an open configuration to a closed configuration;

a first crimping die and a corresponding second crimping die; and a die carrier configured to support the first crimping die or the second crimping die, wherein the die carrier is operatively connected to the first lever handle or the second lever handle and is slideably arranged between the guide rails, wherein the guide rails are substantially bar-shaped and oriented in a common longitudinal direction, wherein the die carrier is configured to slide in a linear direction parallel to the a longitudinal direction of the guide rails along inner opposite faces of the guide rails, thereby being guided from a cable receiving position to a crimping position, wherein the die carrier is configured to support two first crimping dies, wherein the two first crimping dies are crimping anvils and are provided at different anvil heights or wherein surfaces of the two first crimping dies are provided with different radii of curvature, and wherein the hand crimp tool further comprises a spacer which can be inserted in between the two first crimping dies or the two second crimping dies.

9. The hand crimp tool according to claim 8, wherein the crimping frame has a long side of length and a short side of length, and wherein a ratio of the long side of length to the short side of length is in a range of 1:1 to 5:1.

10. The hand crimp tool according to claim 8, wherein the crimping frame has a long side of length and the guide rails have a substantially rectangular cross-section, and wherein a ratio of the long side of length and a length of one side of the rectangular cross-section is in a range of 5:1 to 20:1.

11. The hand crimp tool according to claim 8, wherein the crimping frame further comprises means for continuously moving the second crimping die substantially parallel to the longitudinal direction of the guide rails.

12. The hand crimp tool according to claim 11, wherein the means for continuously moving the second crimping die comprise two corresponding adjustment members.

13. The hand crimp tool according to claim 8, wherein at least one means for non-continuously moving the second crimping die in a direction substantially parallel to the longitudinal direction is provided for providing a rough adjustment of a distance between the corresponding first and second crimping dies.

14. The hand crimp tool according to claim 8, wherein at least one of the first crimping die and second crimping die is removably mounted to the crimping frame.

15. A hand crimp tool for crimping electrical contact terminals onto electrical cables, comprising:

a crimping frame with two substantially parallel guide rails, a first lever handle, and a second lever handle, wherein the first and second lever handles are configured to be manually operated by an operator, thereby being brought from an open configuration to a closed configuration;

a first crimping die and a corresponding second crimping die; and a die carrier configured to support the first crimping die or the second crimping die, wherein the die carrier is operatively connected to the first lever handle or the second lever handle and is slideably arranged between the guide rails, wherein the guide rails are substantially bar-shaped and oriented in a common longitudinal direction, and wherein the die carrier is configured to slide in a linear direction parallel to the a longitudinal direction of the guide rails along inner opposite faces of the guide rails, thereby being guided from a cable receiving position to a crimping position, wherein the guide rails are mutually connected at respective distal rail ends via a U-shaped support arch, which is configured to support the second crimping die wherein the crimping frame further comprises means for continuously moving the second crimping die substantially parallel to the longitudinal direction of the guide rails, wherein the means for continuously moving the second crimping die comprise two corresponding adjustment members, and wherein at least a first adjustment member of the two corresponding adjustment members is arranged movable in a direction substantially perpendicular to the longitudinal direction of the guide rails, and upon movement of said first adjustment member an inclined abutment surface of the first adjustment member abuts a corresponding surface of a second adjustment member of the two corresponding adjustment members such that the second adjustment member is pressed in another direction substantially parallel to the longitudinal direction of the guide rails.

16. The hand crimp tool according to claim 15, wherein the second crimping die is removably connected to one of the first and second adjustment members.

17. The hand crimp tool according to claim 15, wherein the first adjustment member is provided with a bore with inner screw threads and the crimping frame is provided with a corresponding screw, such that the first adjustment member can be moved in the direction perpendicular to the longitudinal direction of the guide rails by turning the corresponding screw.

18. The hand crimp tool according to claim 15, wherein the crimping frame has a long side of length and a short side of length, and wherein a ratio of the long side of length to the short side of length is in a range of 1:1 to 5:1.

19. The hand crimp tool according to claim 15, wherein the crimping frame has a long side of length and the guide rails have a substantially rectangular cross-section, and wherein a ratio of the long side of length and a length of one side of the rectangular cross-section is in a range of 5:1 to 20:1.

20. The hand crimp tool according to claim 15, wherein at least one means for non-continuously moving the second crimping die in a direction substantially parallel to the longitudinal direction is provided for providing a rough adjustment of a distance between the corresponding first and second crimping dies.

21. The hand crimp tool according to claim 15, wherein at least one of the first crimping die and second crimping die is removably mounted to the crimping frame.

22. A hand crimp tool for crimping electrical contact terminals onto electrical cables, comprising:

a crimping frame with two substantially parallel guide rails, a first lever handle, and a second lever handle, wherein the first and second lever handles are configured to be manually operated by an operator, thereby being brought from an open configuration to a closed configuration;

a first crimping die and a corresponding second crimping die; and a die carrier configured to support the first crimping die or the second crimping die, wherein the die carrier is operatively connected to the first lever handle or the second lever handle and is slideably arranged between the guide rails, wherein the guide rails are substantially bar-shaped and oriented in a common longitudinal direction, wherein the die carrier is configured to slide in a linear direction parallel to the a longitudinal direction of the guide rails along inner opposite faces of the guide rails, thereby being guided from a cable receiving position to a crimping position, wherein the guide rails are mutually connected at respective distal rail ends via a U-shaped support arch, which is configured to support the second crimping die, wherein the crimping frame further comprises means for continuously moving the second crimping die substantially parallel to the longitudinal direction of the guide rails, and wherein the means for continuously moving the second crimping die comprise at least one screw which is configured to be screwed into a corresponding bore hole with inner threads which is provided in the U-shaped support arch.

23. The hand crimp tool according to claim 22, wherein the crimping frame has a long side of length and a short side of length, and wherein a ratio of the long side of length to the short side of length is in a range of 1:1 to 5:1.

24. The hand crimp tool according to claim 22, wherein the crimping frame has a long side of length and the guide rails have a substantially rectangular cross-section, and wherein a ratio of the long side of length and a length of one side of the rectangular cross-section is in a range of 5:1 to 20:1.

25. The hand crimp tool according to claim 22, wherein the means for continuously moving the second crimping die comprise two corresponding adjustment members.

26. The hand crimp tool according to claim 22, wherein at least one means for non-continuously moving the second crimping die in a direction substantially parallel to the longitudinal direction is provided for providing a rough adjustment of a distance between the corresponding first and second crimping dies.

27. The hand crimp tool according to claim 22, wherein at least one of the first crimping die and second crimping die is removably mounted to the crimping frame.

* * * * *